US009119431B2

(12) United States Patent
Bain

(10) Patent No.: US 9,119,431 B2
(45) Date of Patent: Sep. 1, 2015

(54) HELMET FOR REDUCING CONCUSSIVE FORCES DURING COLLISION

(76) Inventor: Juliana Bain, Arlington, VA (US)

( * ) Notice: Subject to any disclaimer, the term of this patent is extended or adjusted under 35 U.S.C. 154(b) by 31 days.

(21) Appl. No.: 13/477,157

(22) Filed: May 22, 2012

(65) Prior Publication Data

US 2012/0297525 A1 Nov. 29, 2012

Related U.S. Application Data

(60) Provisional application No. 61/457,739, filed on May 23, 2011.

(51) Int. Cl.
*A42B 3/00* (2006.01)
*A42B 3/06* (2006.01)

(52) U.S. Cl.
CPC ..... *A42B 3/003* (2013.01); *A42B 3/069* (2013.01)

(58) Field of Classification Search
CPC ..... A42B 3/00; A42B 3/06; A42B 3/12; A42B 3/003; A42B 3/69
USPC ..... 2/10, 410–413, 425
See application file for complete search history.

(56) References Cited

U.S. PATENT DOCUMENTS

| | | | | | |
|---|---|---|---|---|---|
| 2,293,308 | A | * | 8/1942 | Riddell, Sr. et al. | 2/410 |
| 2,296,335 | A | * | 9/1942 | Brady | 2/412 |
| 2,618,780 | A | * | 11/1952 | Cushman | 2/413 |
| 3,174,155 | A | * | 3/1965 | Pitman | 2/411 |
| 3,562,811 | A | * | 2/1971 | Allen | 2/423 |
| 3,761,959 | A | * | 10/1973 | Dunning | 2/413 |
| 3,872,511 | A | * | 3/1975 | Nichols | 2/413 |
| 4,209,858 | A | * | 7/1980 | Coenen | 2/412 |
| 4,479,269 | A | * | 10/1984 | Balliet | 2/23 |
| 4,615,438 | A | * | 10/1986 | Rosenberg et al. | 206/223 |
| 4,627,114 | A | * | 12/1986 | Mitchell | 2/414 |
| 4,993,082 | A | * | 2/1991 | Gentes et al. | 2/410 |
| 5,732,414 | A | * | 3/1998 | Monica | 2/425 |
| D406,399 | S | * | 3/1999 | Hohdorf | D29/106 |
| 6,101,636 | A | * | 8/2000 | Williams | 2/410 |
| 6,305,028 | B1 | * | 10/2001 | Lin | 2/410 |
| 6,351,853 | B1 | * | 3/2002 | Halstead et al. | 2/413 |
| 6,826,509 | B2 | * | 11/2004 | Crisco et al. | 702/141 |
| 7,854,025 | B2 | * | 12/2010 | Spinelli | 2/425 |
| 8,499,366 | B2 | * | 8/2013 | Nimmons et al. | 2/425 |
| 2008/0045871 | A1 | * | 2/2008 | Allen | 602/17 |
| 2011/0107503 | A1 | * | 5/2011 | Morgan | 2/456 |
| 2011/0179557 | A1 | * | 7/2011 | Rabie | 2/411 |

OTHER PUBLICATIONS

F.J. Mills et al., Long duration acceleration, British Medical Journal, vol. 286, pp. 1557-1559 (May 14, 1983).

(Continued)

*Primary Examiner* — Richale Quinn
(74) *Attorney, Agent, or Firm* — Cloudigy Law, PLLC

(57) ABSTRACT

An improved design for a helmet to reduce injuries caused by helmet-to-helmet collisions. The helmet has a thin layer of padding added onto the hard shell of the helmet. The padding may be textured to add "crumple zones." A thin, rugged, low-friction exterior cover is affixed to the padding. In one embodiment of the helmet, the cover is separated slightly from the padding to provide air space. The air space, combined with the textured padding, provides a substantial reduction in peak acceleration resulting from a helmet-to-helmet collision.

5 Claims, 5 Drawing Sheets

(56) References Cited

OTHER PUBLICATIONS

S. Mraz, Helmets go Head-to-Head in NFL Testing, Machine Design (Mar. 2, 2011), available at http://machinedesign.com/article/helmets-go-head-to-head-in-nfl-testing-0302 (last visited May 21, 2012).

C. Demarest, Collision Physics for Football Helmets, Presented to NFL HNS Committee (Dec. 8, 2010), available at http://www.hansonco.net/Collision physics for football helmets.pdf (last visited May 21, 2012).

L. Blakley, History of the Football Helmet, Past Time Sports website, available at http://www.pasttimesports.biz/history.html (last visited May 21, 2012).

D. Frankiewicz et al.,Traumatic brain injury reducing army combat helmet, University of Connecticut School of Nursing, available at http://www.bme.uconn.edu/sendes/Spring09/Team6/Proposal.pdf (last visited May 21, 2012).

* cited by examiner

HELMET FOR REDUCING CONCUSSIVE FORCES DURING COLLISION

CROSS-REFERENCE TO RELATED APPLICATIONS

This application claims priority under 35 U.S.C. §119(e) to provisional patent application Ser. No. 61/457,739, which is hereby incorporated by reference.

THE NAMES OF THE PARTIES TO A JOINT RESEARCH AGREEMENT

Not Applicable

INCORPORATION-BY-REFERENCE OF MATERIAL SUBMITTED ON A COMPACT DISC

Not Applicable

BACKGROUND OF THE INVENTION

1. Field of the Invention

The present invention is for a protective helmet. This helmet could be used in sports activities, like football.

2. Description of Related Art

The collision between hard helmets is an elastic collision, with little energy lost like when billiard balls collide. Previous attempts by football leagues to put padding on helmet exteriors have failed because of cost and the fact that modified helmets were bulky and strange-looking. In addition, helmets that are too soft on the outside carry the risk of neck injury because of the friction that is generated during collisions.

There is a need for a safer helmet. This helmet should be able to be manufactured cost-effectively, whether by retrofitting existing helmets or by manufacturing new helmets. The new safety features of this helmet should be integrated into the exterior of the helmet in an aesthetically pleasing way, in order to encourage its adoption.

BRIEF SUMMARY OF THE INVENTION

The present invention uses a thin, low-friction, and inexpensive padding on the outside of a helmet. Testing of this padding demonstrates significant reduction in peak acceleration to the brain in helmet collisions.

An existing helmet can be retrofitted with exterior padding by first applying a padding such as moleskin to the outer surface of the helmet, and then vacuum thermoforming a cheap PETG plastic exterior cover over the padding. Although there is some benefit to a smooth surface, there are substantial benefits to molding shapes into the exterior cover. One embodiment uses textured spirals. Another uses textured Celtic knots. Other shapes are also possible as well as other cushioning materials and shielding materials (instead of moleskin and PETG plastic, respectively), as would be evident to one of ordinary skill in the art.

DETAILED DESCRIPTION OF THE INVENTION

Figure 1:
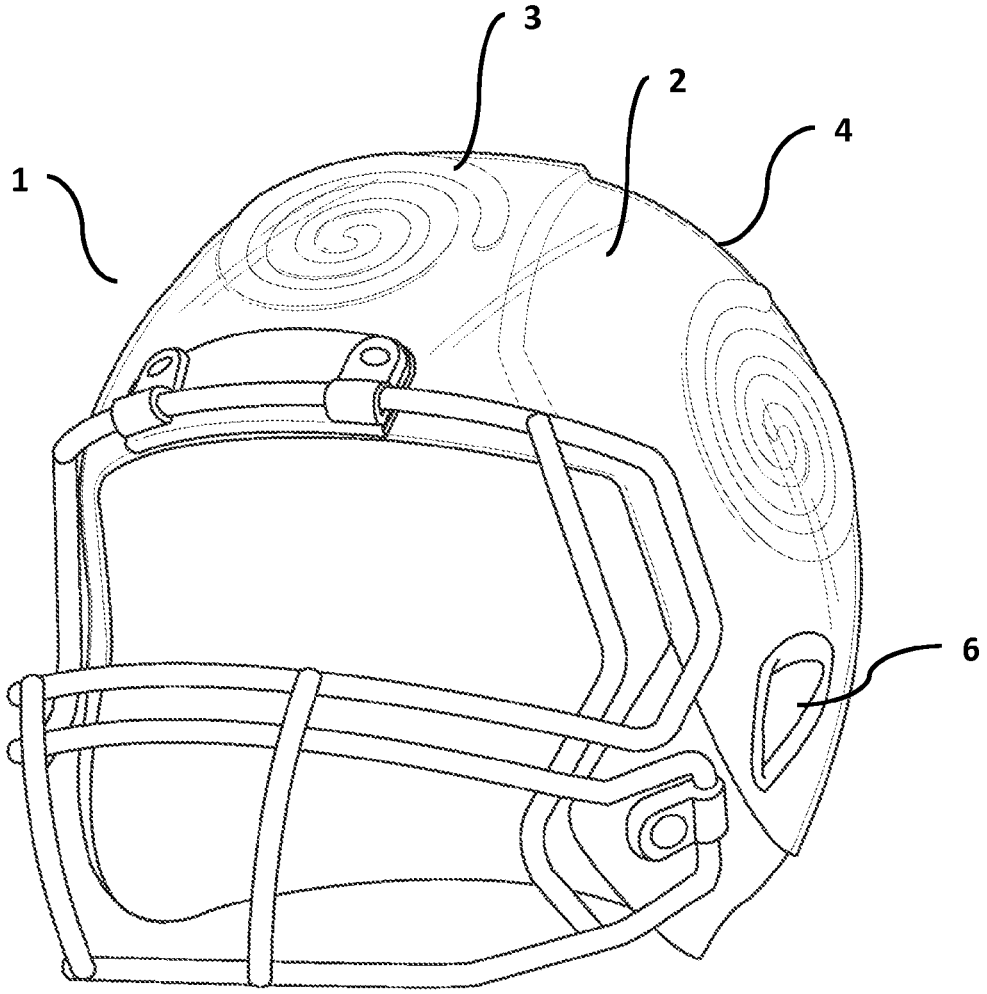
FIG. 1 shows a front perspective view of one embodiment of the present invention.
Figure 2:
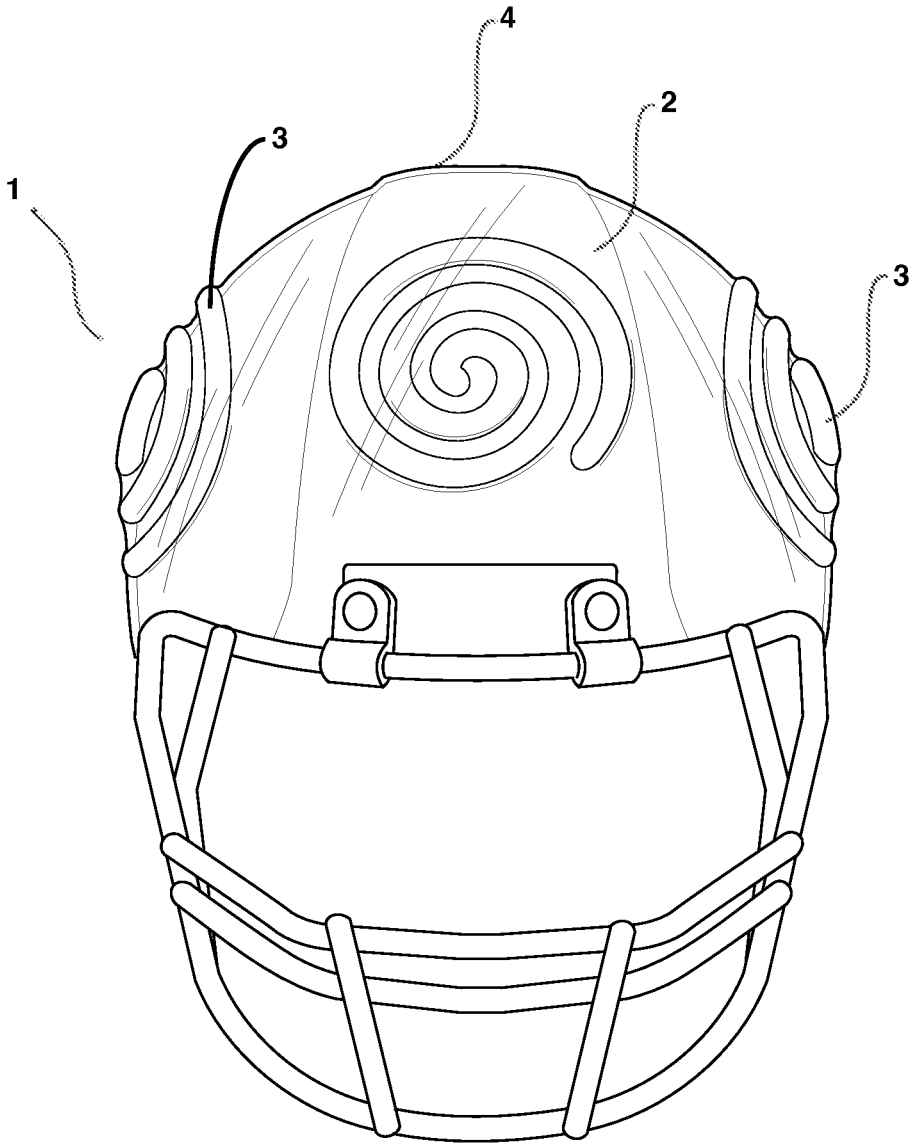
FIG. 2 shows a front view of one embodiment of the present invention.
Figure 3:
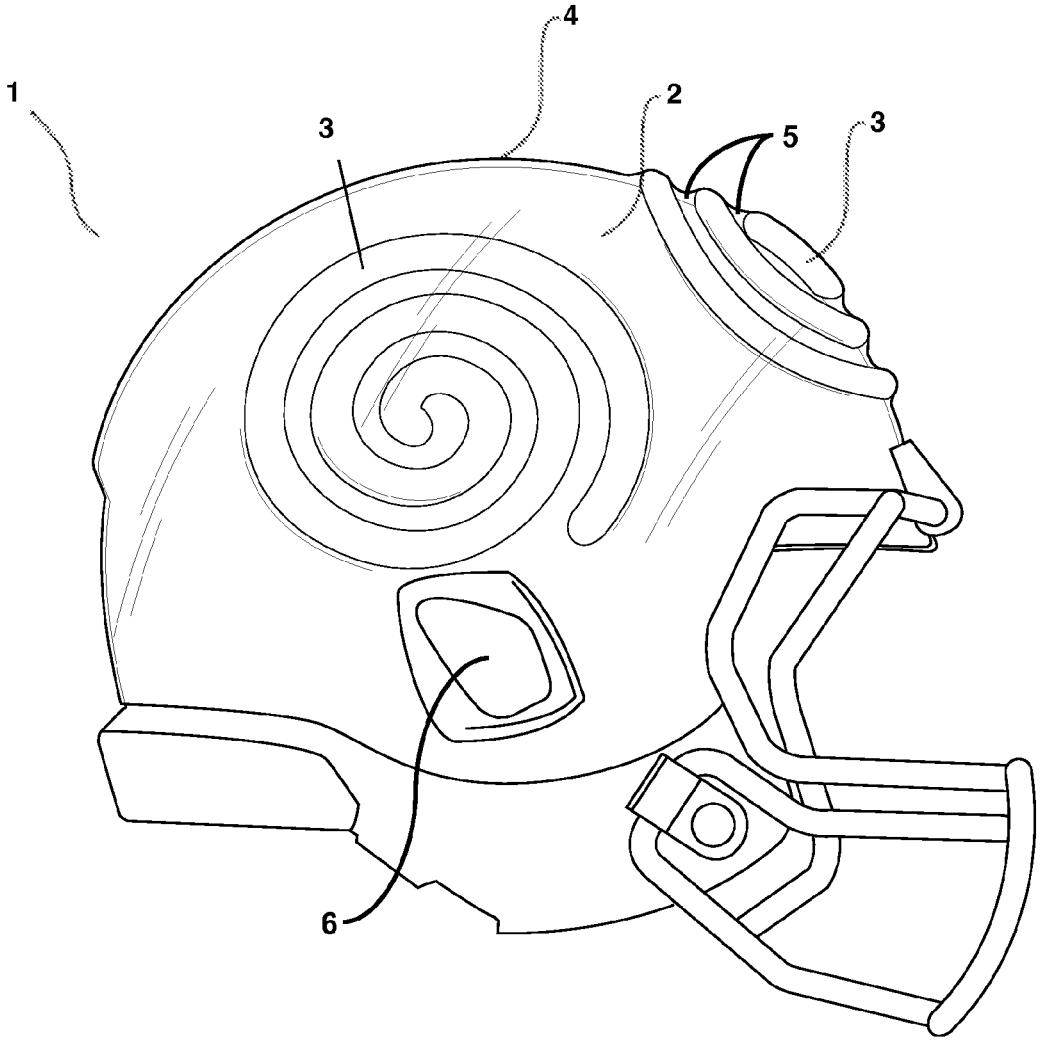
FIG. 3 shows a side view of one embodiment of the present invention.
Figure 4:
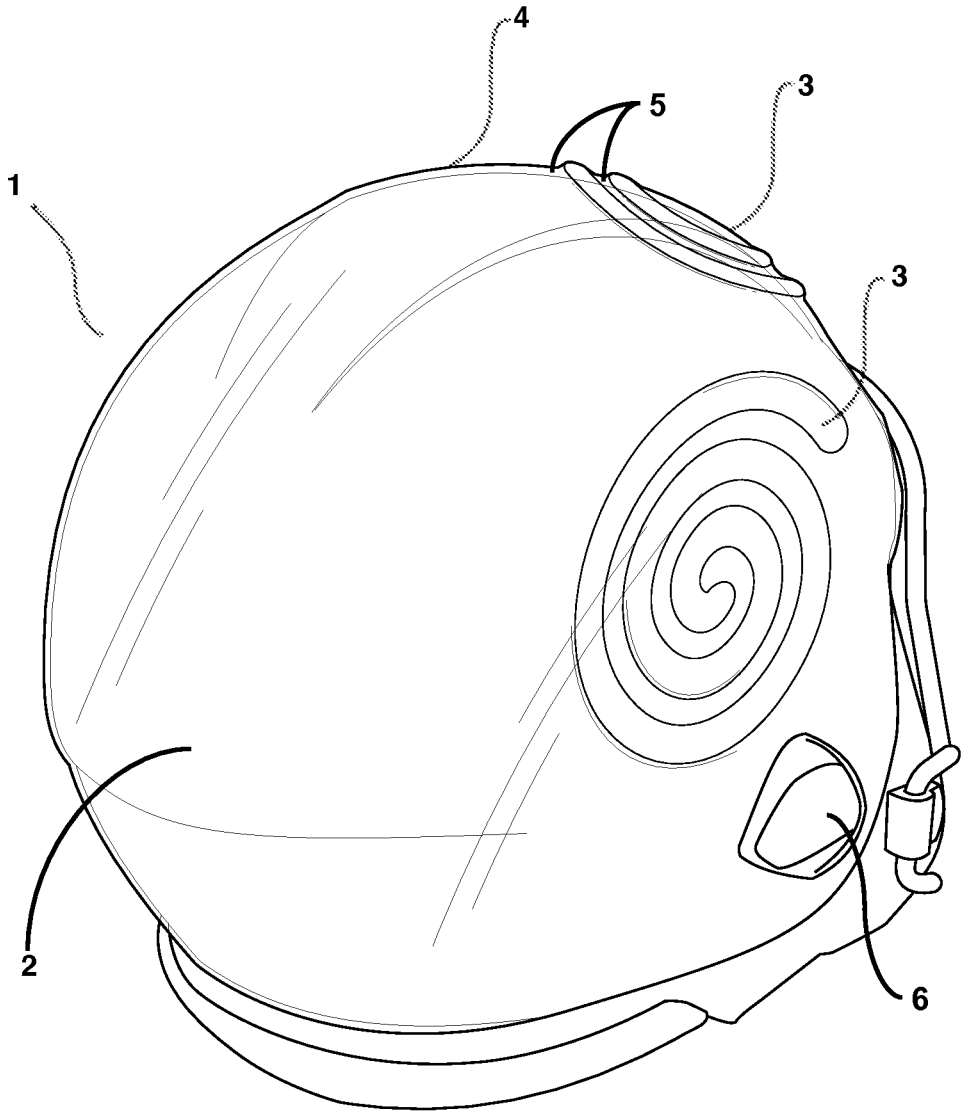
FIG. 4 shows a back perspective view of one embodiment of the present invention.

FIGS. 1-4 illustrate an embodiment of the present invention. The present invention comprises a standard helmet 1, such as a football helmet, that has outside the hard shell 2 a layer of padding 3. The padding 3 may have no design or may be in the shape of 3-dimensional decorative adhesive stickers that, in addition to providing a certain amount of cushion, may take on a decorative or informational quality (such as a team insignia or a player number, code, or unique image). In addition, the illustrated helmet has an exterior cover 4 that goes outside the layer of cushions cushioned padding.

The exterior cover 4 may bow outwardly to form a protective casing or bubble to provide additional resistance and cushioning from collision. This air space 5 around the hard shell 2 also increases the overall surface area of the outer cover 4 to distribute the pressure of collisions over a greater surface area. Using an outer cover 4 around the padding 3 also provides a low-friction surface to the helmet 1 in order to lower the risk of neck injuries by deflecting the force from collisions and allowing glancing blows to occur instead of the helmets locking together.

The exterior cover 4 may be see-through or opaque. Indicia such as the team insignia may be placed on the outer hard shell 2, especially if the exterior cover 4 is transparent so that people could see the insignia. The padding 3 between the outer hard shell 2 of the helmet and the exterior cover 4 can be adhered with glue, affixed mechanically or otherwise attached to either the hard shell 2, or to the cover 4, or both the hard shell 2 and the cover 4. One way to attach the cover 4 is to adhere the padding 3 to the shell 2 and maintain an air space 5 between the padding 3 and the cover 4. In another embodiment, the padding 3 is adhered both to the exterior of the hard shell 2 and the interior of the cover 4. Another variation may be to texture the padding 3 with ridges, bumps, or other shapes such that the force from a collision is distributed over a greater surface area and increase the amount of air pockets and crumple zones. The use of textures to increase surface areas bearing the force of collisions could also be applied to the inside and outside of the thin plastic cover and the inside and outside of the hard shell 2 of the helmet 1. In the illustrated embodiment, padding 3 comprises a spiral shape.

The padding 3 may be made from moleskin, polyethylene foam, or other suitable material. The cover 4 can be made of any material that provides a sufficiently rugged, but low-friction surface. For example, a thin plastic would be suitable, provided that it has the desired properties. In some embodiments, the cover 4 and hard shell 2 incorporate cooperating holes such as earholes 6 for ventilation or other climate control. In some embodiments, the padding 3 is inflatable. In such embodiments, the cover 4 has a hole at the top for the pump needle to inflate the padding 3. The padding 3 and outer cover 4 may be replaceable when damaged or for other reasons.

To test the present invention, a hole was drilled in the back of one helmet and a rope was attached to it to ensure consistency in the dropping of the helmet. A second helmet was placed on the floor, stabilized between two bags of playground sand. An accelerometer was mounted on a piece of wood and that wood was mounted inside the helmet such that it would measure acceleration changes in a direct, downward direction. The helmets were aligned so that when the top helmet was released, the front of both helmets collided. Drop test data was collected in sets of 10 for each of the experimental variations from a height of 70 cm. The data were collected on a computer and were analyzed to isolate the shock of the initial impact from the subsequent bouncing or other "noise."

Data from testing supports the hypothesis that shock attenuation can be improved through the use of designs that maximize mechanical resistance and surface area of the semi-rigid plastic shield. Parts of the plastic shield showed signs of stress after hard collisions, which suggests that the proposed design could also be useful to help detect when and where players' brains have been exposed to stresses.

Figure 5:
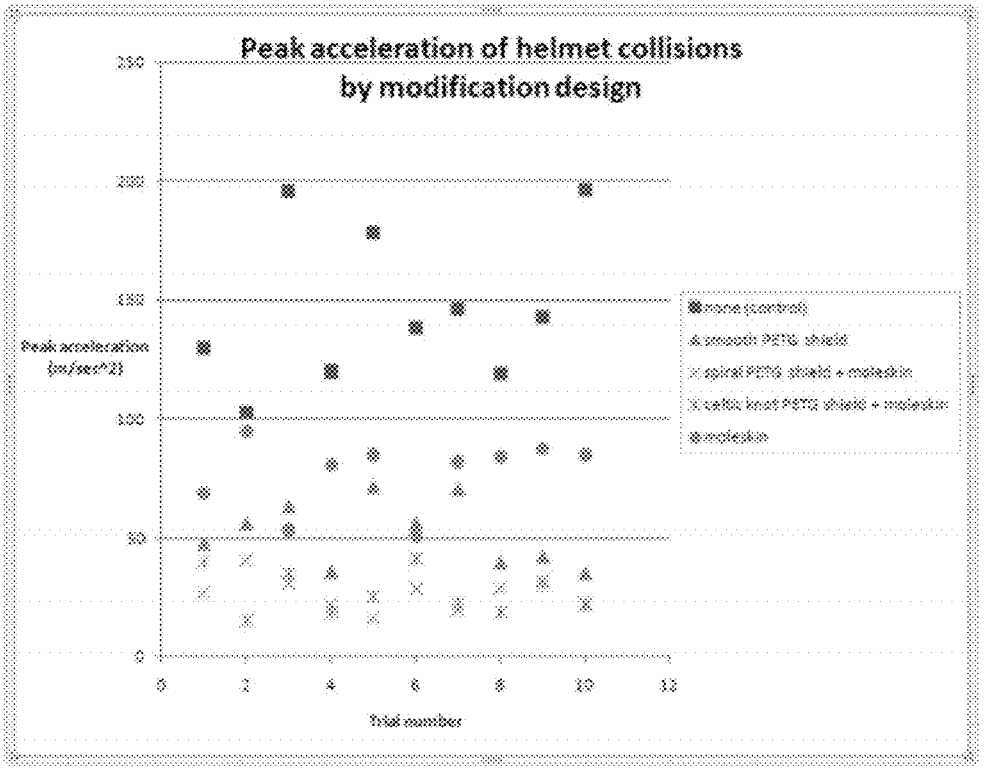
FIG. 5 shows experimental results demonstrating the effectiveness of the present invention at reducing peak acceleration resulting from helmet-to-helmet collisions.

The graph in FIG. 5 shows the results of testing. The following table compares the mean and range peak acceleration (m/sec^2) in helmet collisions with varying configuration of padding:

| Padding on exterior | Mean | Range |
|---|---|---|
| None(control) | 146.83 | 93.5 |
| Moleskin | 77.14 | 43.5 |
| Moleskin with smooth PETG shield | 51.93 | 36.5 |
| Moleskin with Celtic knot design PETG shield | 26.93 | 25.9 |
| Moleskin with spiral design PETG shield | 26.63 | 24.7 |

The present invention reduces peak acceleration when such helmets 1 are collided. The reduction in peak acceleration is at least partially dependent on the padding configuration on the exterior. In testing, average peak acceleration of a control football helmet was 146.83 m/sec^2. The average peak acceleration of the standard football helmet was 146.83 m/sec^2. The average peak acceleration of the helmet with moleskin was 77.14 m/sec^2. This is a 47% improvement over the control. The average peak acceleration of the helmet with plain plastic and moleskin was 51.93 m/sec^2. This is almost a 65% improvement over the control. Second best was the helmet with the Celtic knot design with an average peak acceleration of 26.93 m/sec^2. This is almost an 82% improvement over the control. The helmet with spirals preformed the best, with an average peak acceleration of 26.63 m/sec^2, just three tenths of a m/sec^2 better than the Celtic knot design. This is almost an 82% improvement over the control. The helmets with designs (Celtic knot and spiral) most successfully reduced the peak acceleration because the surface area was greater and could therefore better distribute the force over a greater area and spread the collision over a greater interval of time. This is similar to the design approach used in making "crumple zones" for automobiles.

It is also envisioned that as football helmets will have increased numbers of sensors and that the sensors will be able to do a number of things. First of all, they will be able to calculate the peak acceleration of any helmet collisions. If the hit is greater than 80 G's, the medics will pull the player over. If the hit is below 80 G's, the player may be able to continue playing (unless the player shows TBI symptoms, of course). The sensors will also be able to calculate the players' speed in real time and project it onto the Jumbotron®, Internet, or TV. Lastly, the sensors will be able to calculate the peak acceleration of any collision.

The described embodiments could be applied by one of ordinary skill in the art to other types of protective gear, such as shoulder, knee, or elbow protectors as well as protectors for any equipment subject to damage due to dropping or other shock, such as a cell phone, tablet or laptop computer, or sensitive components in cars or airplanes.

The described embodiments are not intended to be exhaustive descriptions of the present invention. Other variations are also possible, as would be understood by one of ordinary skill in the art.

The invention claimed is:

1. A retrofitted helmet comprising:

an inner football helmet that is retrofitted with (1) a plurality of discrete padding shapes, each of which is constructed substantially from polyethylene foam or moleskin material, and each of which is affixed by an adhesive to a separate discrete area of the outer surface of the inner football helmet; and (2) a low-friction thin molded PETG plastic exterior surface affixed to and covering all of the padding shapes and extending over the outer surface of the inner football helmet to form a contiguous protective space of air between at least a portion of the plastic exterior surface and the outer surface of the inner football helmet;

wherein at least one of the padding shapes comprises a decorative design; and wherein the exterior surface is textured by the discrete padding shapes.

2. The retrofitted helmet of claim 1, wherein the exterior surface is opaque.

3. The retrofitted helmet of claim 1, wherein the exterior surface is transparent.

4. The retrofitted helmet of claim 1, wherein the decorative design is a spiral.

5. The retrofitted helmet of claim 1, wherein the decorative design is a team insignia.

* * * * *